United States Patent [19]

Weiss

[11] 4,434,737

[45] Mar. 6, 1984

[54] DISPLACEMENT, PLANING SAILBOARD

[75] Inventor: John Weiss, West Babylon, N.Y.

[73] Assignee: Wind Innovations, Inc., Cutchogue, N.Y.

[21] Appl. No.: 302,830

[22] Filed: Sep. 16, 1981

[51] Int. Cl.[3] ..... B63B 1/16; B63B 1/04

[52] U.S. Cl. ..... 114/39; 114/56; 114/271

[58] Field of Search ..... 441/74, 65, 79; 114/39, 114/56, 61, 271, 291, 292

[56] References Cited

U.S. PATENT DOCUMENTS 1,204,058 11/1916 Pfeiffer ..... 114/271
3,487,800 1/1970 Schweitzer ..... 114/91 X
3,593,356 7/1971 Schmalfeldt ..... 441/74
4,079,688 3/1978 Diry ..... 114/56

OTHER PUBLICATIONS

"Surf Magazine", Germany, Nov. 16, 1980, pp. 29, 42, 43, and 60.

*Primary Examiner*—Sherman D. Basinger
*Attorney, Agent, or Firm*—Frishauf, Holtz, Goodman & Woodward

[57] ABSTRACT

A highly efficient sailboard shape has a full displacement form for efficient light and upwind sailing and has an efficient planing form for high wind sailing with the conversion from displacement to planing forms caused by the buoyance reaction to aftward weight shift.

5 Claims, 9 Drawing Figures

DISPLACEMENT, PLANING SAILBOARD

This invention relates to a single sailboard hull shape to efficiently sail at high and low speeds.

BACKGROUND OF THE INVENTION

Sailboards operate at speed to length ratios higher than any other sailboats. Hydrodynamic drag affecting sailboat speed is comprised of two major factors, residuary resistance and frictional resistance. The residuary drag is the result of form drag and wave making drag, energy used to displace water and create the wake. The frictional resistance is the result of shearing water and is directly related to the wetted surface area. At low speeds the residuary resistance is the major portion of the total drag. The factor most effecting this drag is the water line length, longer hulls are faster for the same displacement. A hull produces a characteristics wave, the wave length being a function of speed. For a given water line length a displacement hull will reach a speed limit, hull speed, above which the drag increases exponentially. The only way to increase speed at this point is to have a planing effect to raise the hull up and reduce the volumetric displacement and the wetted surface area. In the planing regime the major contributor to drag is the frictional component, a direct function of surface area. Hydrofoils are the extreme of low surface area planing.

The early sailboards, (e.g. Darby "Popular Science" August 1965 pages 138–141) had flat bottom planing form with either a flat or pointed bow and almost no rocker. Since these early models were sailed mostly in lakes their was no need to break over waves. The next breakthrough in board design was the adaptation to a surfboard shape with longitudinal rise, rocker, in the bow and in the stern.

The fastest sailboards today are the flat bottom, wave jumpers, that take advantage of high planing forces, however this type of design can not compete in upwind sailing because of poor acceleration and poor pointing ability as a result of the flat bottom. The modern regatta boards are a trade-off between boats and surfboards and are considered to be semi displacement hull forms. The characteristics that sets these boards aside from displacement hull forms is the extreme amount of bow rocker in the semi displacement as opposed to a deep fore foot with almost no rocker in displacement hull form.

Another approach to advanced sailboard hull forms is the Wing Form (Russell U.S. Pat. No. 3,742,887) designed with a tunnel concave center to trap air, increase stability and aid in planing lift.

SUMMARY OF THE INVENTION

It is an object of this invention to provide a hull shape for a sailboard that is highly efficient in light wind and is highly efficient in heavy wind conditions.

Briefly, by my invention the sailor is able to take advantage of his ability to drastically shift the center of gravity of a sailboard aft in higher winds and forward in light wind to change the attitude or pitch angle of the sailboard and to utilize a shape that has a full displacement form toward the bow, a planing surface aft and a buoyance reaction to the sailor's weight shift fore to aft affecting a conversion form displacement to planning type hull form. This approach to hull design combines both displacement and planing forms.

The hull form comprises a deep forefoot with only a slight rise in the keel line or profile (technically "rocker") toward the bow, a round midsection having maximum beam aft of the half length and a transition to a flat rectangular aft section with extreme and a substantially rectilinear rocker at the stern. The bow was a very sharp entrance angle, 15° to 20° as compared to over 90° for semi displacement forms, the stem is very steep, 25° to 30°, as opposed to 50° to 60° for other boards. The midsection is a wide U section with a beam to height ratio of about 3. The afterbody is flat and wide with a sharp cutoff at the transom.

The deep forefoot provides a maximum effective waterline length to reduce low speed drag and thus maximizing acceleration.

The extreme rocker aft allows the sailboard to pitch when the sailor moves aft as in high wind conditions so that the bow rises out of the water and the flat afterbody approaches a small angle to the impinging flow to increase planing at high speeds.

DETAILED DESCRIPTION OF THE INVENTION

Figure 4:
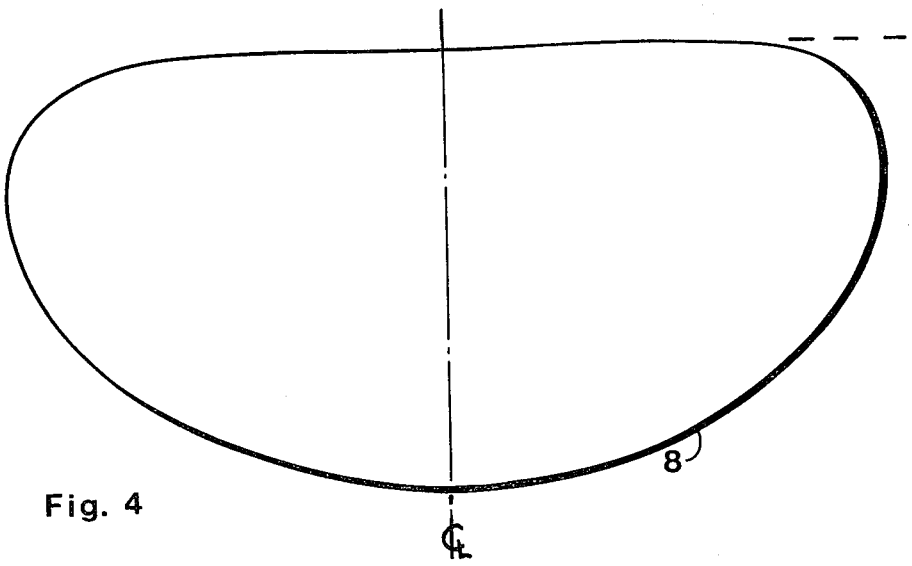
FIG. 4. is a crossection of the midsection.

In the preferred embodiment the hull is of the full displacement type most similar to the U.S. Navy series 64 test forms developed for large military ships. Unlike ships the hull is subjected to an extreme shift in the center of gravity by change of the sailors position, of as much as 25 percent of the overall length and is also subjected to a reduction in weight due to the upward component of lift of the free sail system exerted upon the sailor. The block co-efficient is 0.55 to extend fullness to the displacement form as seen in FIG. 4. The longitudinal co-efficient is 0.68 and is of greater proportion towards the bow 1 in order to place the hydrodynamic center of planing lift 12 in front of the center of gravity 10, to cause the bow to lift at higher speed. This coupled with the center of buoyance 11 plus the weight shift aft will cause the waterline plane to move aft to the midsection of the board while planing.

The centerboard 5 and mast step sockets 6 are located to position the weight of the sailor. As in FIG. 6 the sailor must be able to move up to the stationary center of buoyance 11 and as in FIG. 7 back at least three feet behind this point.

Figure 6:
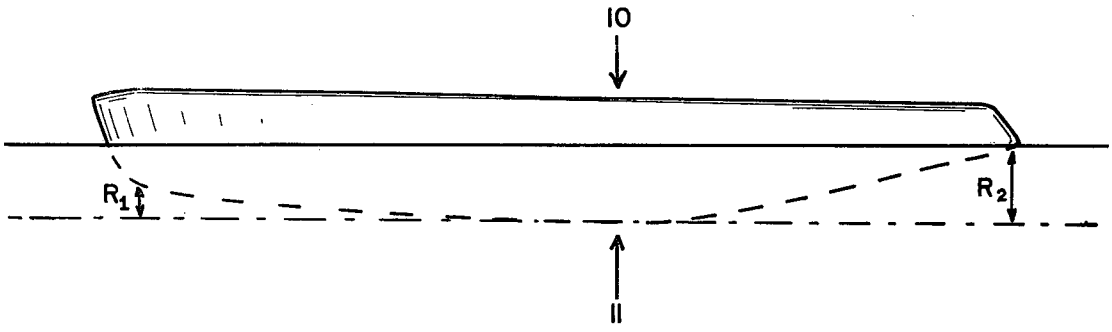
FIG. 6. is a diagramatical illustration showing the attitude of the sailboard in the displacement mode with the center of gravity forward.

The keel line as shown in FIG. 6, is designed to provide a rise $R_2$ at the stern which is at least four times the rise $R_1$ at the bow. The deepest section 8, shown in FIG. 3, is at 60 percent of the length aft of the bow 1 and the aft rocker is nearly a straight line from this point to the transom 2 with a slight leveling off at the stern 4.

Figure 3:
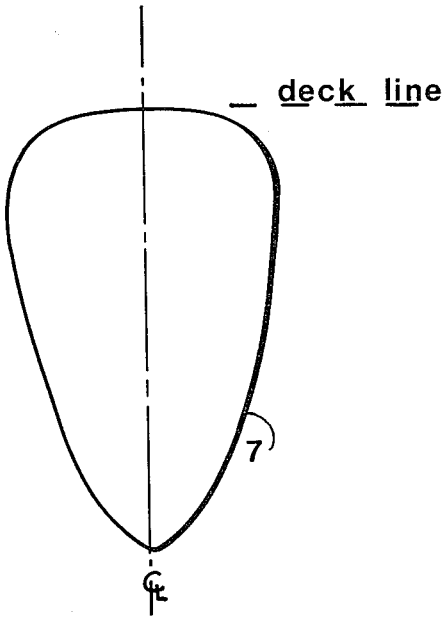
FIG. 3. is a crossection of the forward body showing the depth and narrowness.

The bow sections 7 as represented in FIG. 3 are narrow and deep to provide a clean entry 3 and to extend the effective waterline length.

Figure 5:
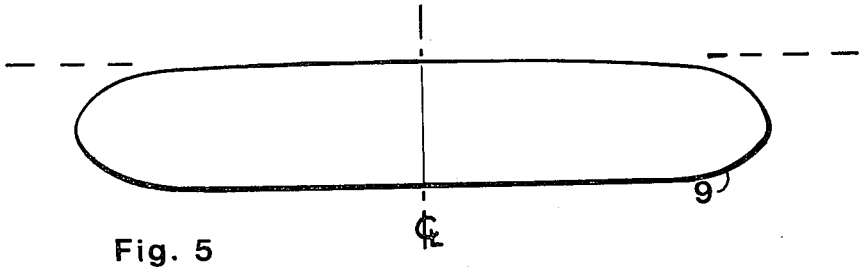
FIG. 5. is a crossection of the stern.

The stern sections 9, FIG. 5., become flatter towards the transom 2 and the bottom surface consists of a flat plane for the aftermost 15 percent of the length.

In the preferred embodiment the overall size conforms to IYRU Division 2 measurement rules having an overall length of 390 cm, a beam of 63 cm and a height of 22 cm, however the scope of this invention is not limited to this particular class.

Sailboard hulls get their speed not only form their length to beam ratio, which is generally higher than 6. In this they intermediate between sailboat hulls, where the length is commonly 3 or 4 times the beam, and catamaran hulls where the length is usually 10 or more times the beam in order not to be unduly limited by form drag.

The technique of sailing this advanced design is not different from sailing other sailboards with a few exceptions. Fore and aft weights shifts should be more extreme than for sailboards in order to take full advantage of the design. Off the wind the most effective directional control is achieved by rolling the board to leeward or to windward as opposed to the normal shifting of the sail to effect steerage.

Figure 2:
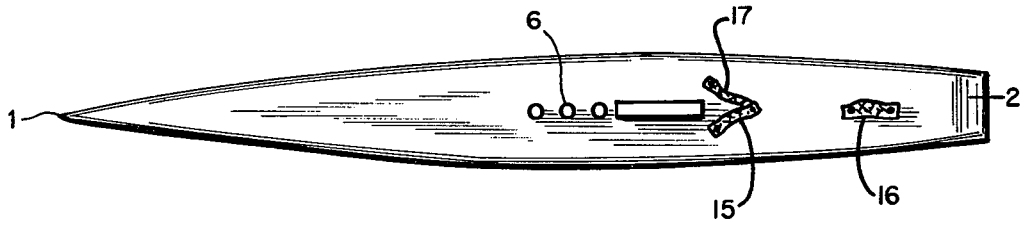
FIG. 2 is a top view of the preferred embodiment showing the sharp bow and wide afterbody.

Footstraps 15, 16, and 17 shown in FIG. 2 are useful for accentuating or controlling the longitudinal tilting of the board by weight-shift into the planing position and while maintaining a planing attitude, but of course they may be omitted. Further footstraps for the forward weight position are not necessary and are therefore not shown, although of course they may be provided or the board may be marked or otherwise surface-treated so that the sailor can readily recognize the normal positions.

The terms "rocker" and "keel line" are conventional terms meaning the longitudinal profile of the hull. The "forefoot" means the intersection or joining of the stem (low extremity line) and the keel (central bottom extremity line, here of forward hull portion) and is usually rounded in a relatively sharp curve. The stem can be vertical, but it is preferably raked somewhat. Its angle to the extension of the line of rise of the keel from the rounded midsection of the hull to the forefoot curve should not be less than about 60° in order to provide adequate waterline length or, where the profile from the rounded mid-section of the hull to the forefoot curve is more curved than straight, the angle of the stem to the extension of the chord between the mid-section and the forefoot curve should be not less than about 60°.

Figure 1:
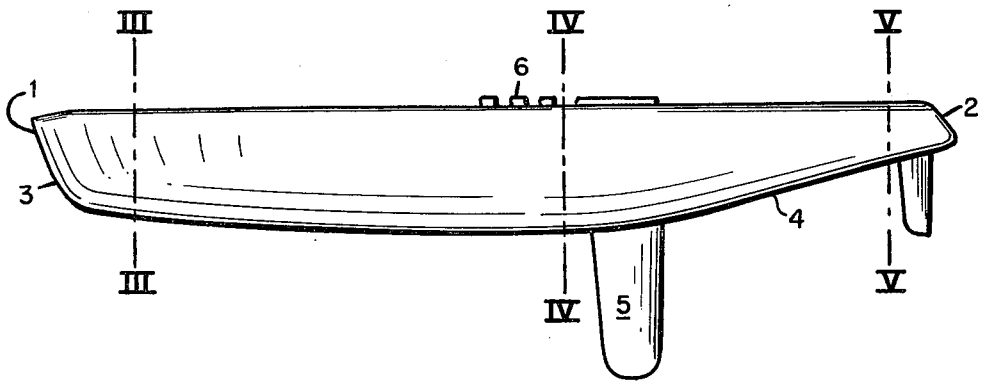
FIG. 1 is a side view of the preferred embodiment showing the deep forefoot and aft rocker.
Figure 7:
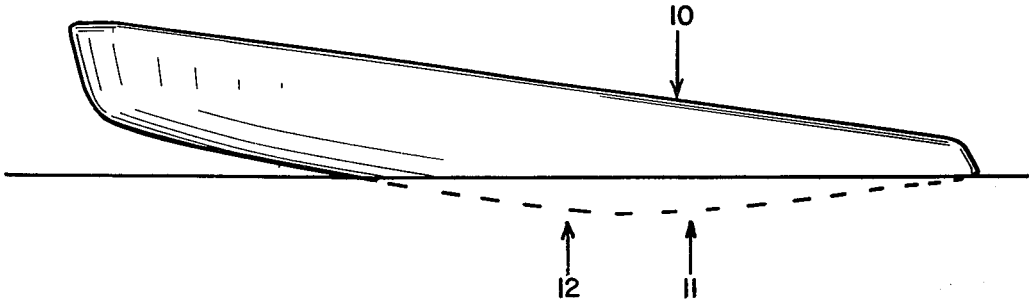
FIG. 7. is a diagramatical illustration showing the attitude of the sailboard in the plaining mode with the center of gravity aft.
Figure 8:
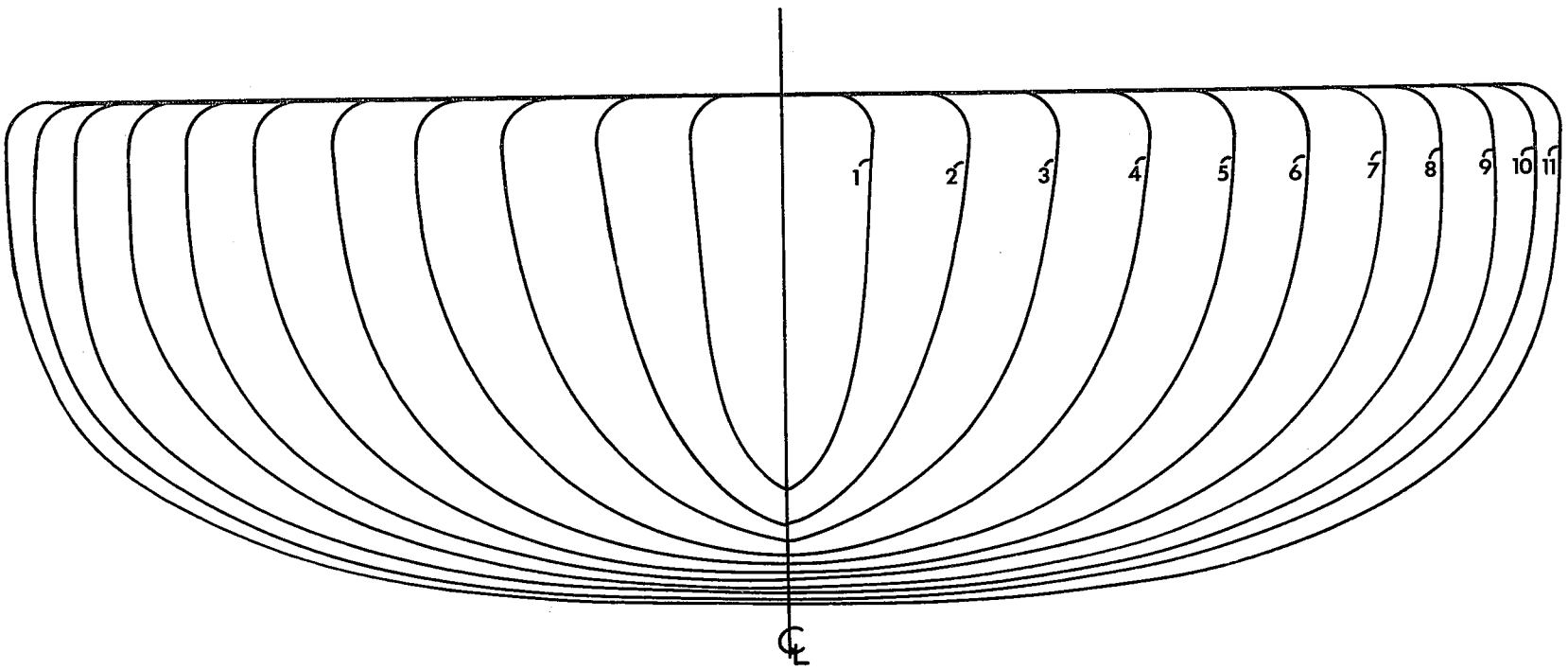
FIGS. 8 and 9 respectively show forward and aft section outlines.

The vertical dimensions of FIGS. 1, 6, and 7 have been exaggerated to show the shape better, and even there the preferred slight flare or levelling of the flat bottom very near the stern hardly shows. Normal proportion can be deduced from the sectional outlines of FIGS. 8 and 9 and the length and beam dimensions given above for the preferred embodiment. These figures show sections at equidistant consecutively numbered stations drawn to the same scale for the aforesaid preferred embodiment, FIG. 8 showing the forward sections and FIG. 9 the aft sections.

Figure 9:
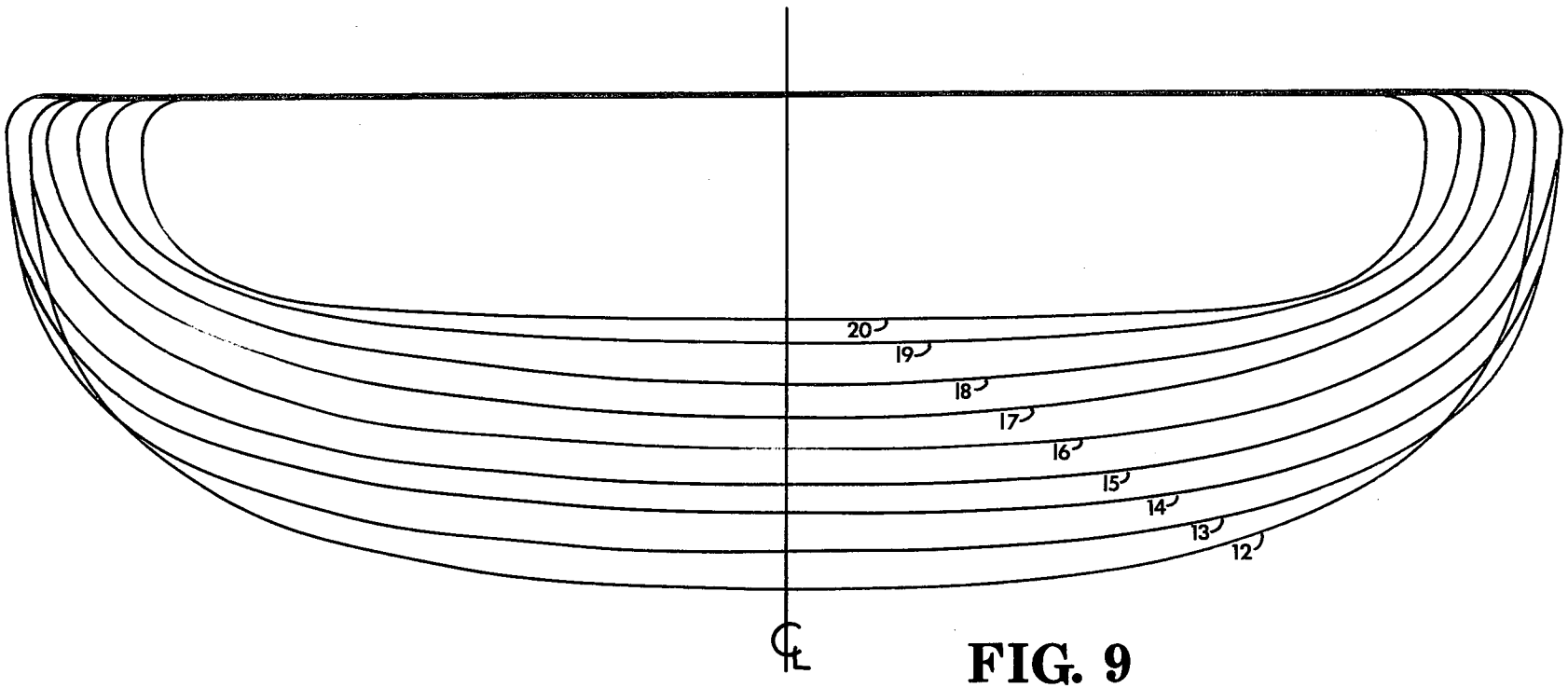

It will be noted in the drawings that the maximum depth, maximum beam and maximum cross-sectional area of the hull are all well aft of amidships. Preferably, they are all located at about 60% of the hull length from the bow. In FIGS. 8 and 9, maximum depth and cross-section is at station 12 and maximum beam at station 13. In presently conventional sailboards the maximum beam is usually forward of amidships.

The sailboard hulls of the present invention may be made by any of the methods well known in the sailboard industry, for example with fiberglass (GRP) shells either hollow or foam-filled, or by injection moldings either solid or over foam. "Exotic" constructions are of course also possible, and these hulls will surely lend themselves readily to construction methods that may be devised in the future.

Although the invention has been described with reference to a particular illustrated embodiment, it will be understood that modifications and variations within the inventive concept are always possible.

I claim:

1. A hull for a sailboard, of a length exceeding 6 times its maximum beam, equipped with mast sockets, centerboard slot, and skeg and having an improved shape for use as a displacement-type hull in light winds and as a planing-type hull in strong winds, comprising:

a forward portion having a deep forefoot, a fine entry and a shape suitable for easy forward movement through water at low speed;

a middle portion of substantially round underwater cross-section;

an aft portion of flat bottom terminating at a wide stern and merging into said middle portion;

a longitudinal profile having not more than a small rise between said middle portion and the forefoot profile curve and having a substantial rise, between said midportion and said stern, which is at least four times the rise between said middle portion and said forefoot profile curve, so that a long substantially flat bottom area is provided for said aft portion which comes closer to the deck surface towards the stern, whereby a forward weight shift of the sailor enables selection of an efficient displacement-type behavior of the hull and, in the event of sufficient wind force, an aft weight shift of the sailor enables selection of an efficient planing behavior.

2. A sailboard hull as defined in claim 1 in which the stem profile is inclined at not less than 60° to the extension of the line or chord of the portion of the longitudinal profile between said midportion and said forefoot profile curve.

3. A sailboard hull as defined in claim 1 or 2 equipped with footstraps for facilitating control by the sailor of the longitudinal inclination of the board in coordination with the shifting of his weight.

4. A sailboard as defined in claim 2, in which the location of maximum girth is at about 60% of the length of the hull from the bow towards the stern.

5. A sailboard as defined in claim 1, in which the location of maximum girth is at about 60% of the length of the hull from the bow towards the stern.

* * * * *